US005940925A

United States Patent [19]

Göhler et al.

[11] Patent Number: 5,940,925

[45] Date of Patent: Aug. 24, 1999

[54] CLEANING LIP DEVICE FOR A ROTATING ROLL OF A TEXTILE MACHINE

[75] Inventors: Wolfgang Göhler, Lenting; Alfred Nauthe, Böhmfeld, both of Germany

[73] Assignee: Rieter Ingolstadt Spinnereimaschinenbau AG, Ingolstadt, Germany

[21] Appl. No.: 08/941,611

[22] Filed: Sep. 30, 1997

[30] Foreign Application Priority Data

Oct. 12, 1996 [DE] Germany ..... 196 42 198

[51] Int. Cl.[6] ..... D01H 5/62

[52] U.S. Cl. ..... 15/256.51; 19/262; 19/264; 19/265; 118/126; 118/413

[58] Field of Search ..... 15/256.51; 19/262, 19/264, 265; 118/126, 261, 413; 101/157, 169, 365, 425; 162/281

[56] References Cited

U.S. PATENT DOCUMENTS

| | | | |
|---|---|---|---|
| 2,329,277 | 9/1943 | Lodding | 15/256.51 |
| 2,498,213 | 2/1950 | Ljungquist | 15/256.51 |
| 3,356,067 | 12/1967 | Krasnow et al. | 118/123 |
| 3,703,019 | 11/1972 | Bratt | 15/256.51 |
| 4,387,663 | 6/1983 | Alheid | 118/413 |
| 4,406,039 | 9/1983 | Hotz | 19/262 |
| 4,586,212 | 5/1986 | Gasser | 15/256.51 |
| 4,819,302 | 4/1989 | Fukada et al. | 19/262 |
| 5,536,312 | 7/1996 | Madrzak et al. | 118/126 |
| 5,846,325 | 12/1998 | Crabtree et al. | 118/413 |

FOREIGN PATENT DOCUMENTS

| | | |
|---|---|---|
| 0437823A1 | 7/1991 | European Pat. Off. . |
| 2142661 | 1/1985 | United Kingdom . |

OTHER PUBLICATIONS

EPO Search Report Dated Feb. 9, 1998.
Rieter Ingolstadt Operations Manual.

*Primary Examiner*—Robert Warden
*Assistant Examiner*—Theresa T. Snider
*Attorney, Agent, or Firm*—Dority & Manning

[57] ABSTRACT

The invention concerns a cleaning lip for a rotating roll of a textile machine in a rolling mill (1) for processing fibrous materials wherein the cleaning lip (9) is comprised of a combined carrying device and a lip, the length (1) of the lip (11, 23) being limited by a wiping edge (AK, $AK_1$), and the lip is composed of plastic. On the lip (11, 23) and in proximity to the carrying device, a groove (12, 24) is placed which runs parallel to said wiping edge (AK, $AK_1$) of the lip. Alternatively, the cleaning lip can be installed for the clearing of wrapping, in that, upon the roll (14) reversing its direction from an original direction, then the wiping edge (AK, $AK_1$) of the lip (11, 23) swings itself out of its original roll surface contact position. Upon a subsequent change of roll rotation back to the original direction, the wiping edge (AK, $AK_1$) also swings itself back to its original wiping contact position.

12 Claims, 4 Drawing Sheets

FIG. 2
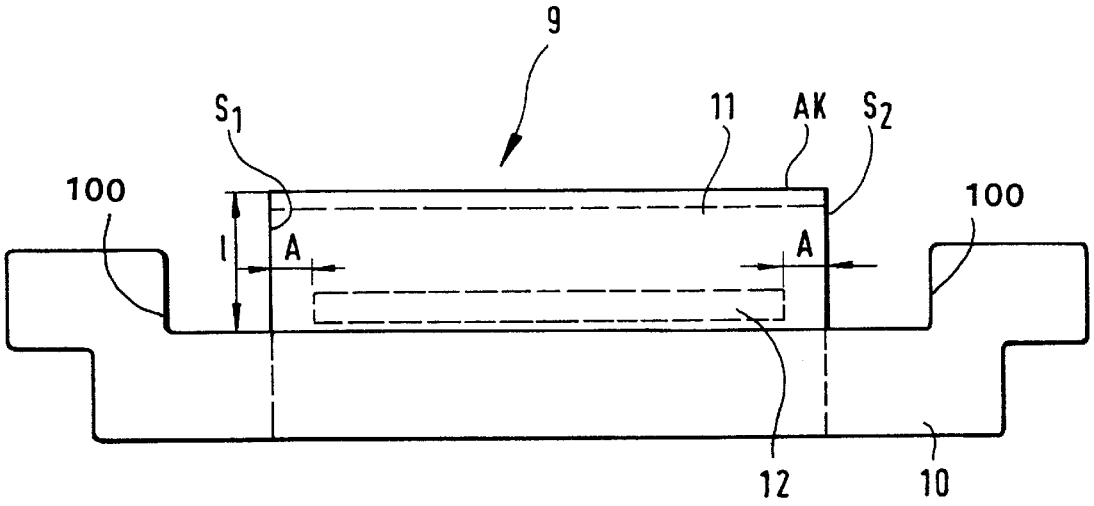
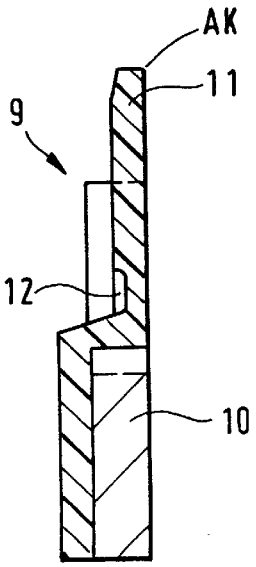
FIG. 3
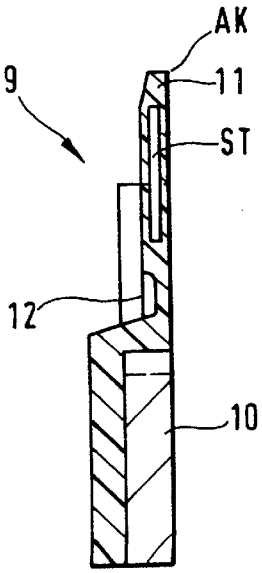
FIG. 3a

CLEANING LIP DEVICE FOR A ROTATING ROLL OF A TEXTILE MACHINE

BACKGROUND OF THE INVENTION

The invention concerns a cleaning lip for a rotating roll of a textile machine in a rolling mill for processing fibrous materials wherein the cleaning lip is comprised of a carrying means integrated with a lip, the length of the lip being limited by a wiping edge and wherein the lip is composed of plastic.

"Textile machine" in its concept encompasses drawing frames, such as carding and stretching machines, as well as spinning machines common to a rolling mill. These textile machines process fiber material, textile in nature. This fiber material includes cotton or its mixtures with artificial fibers. The fiber material can be available as fiber fleece or fiber in band form.

In the rolling mill, pairs of rolls are arranged. A pair is formed by an upper and lower roll, between which the fiber material is guided.

Besides fiber of desired length, on the band being rolled are found short fibers, and contaminating material. Regarded as contamination in cotton are solid dirt particles, pod husk particles, dust, foreign material and, possibly, finishing compounds.

These impurities, as well as fibers, collect upon the outside surface of the roll. There, they disadvantageously interfere in the gap between the pairs of rolls, thus fostering wrapping on the rolls. The formation of wrap-around finally leads to a blockage of the fiber material at the roll pair. In order to avoid this undesirable condition, a cleaning lip is installed in contact with the outer surface of the rotating roll.

Rieter Ingolstadt Spinnereimaschinenbau AG shows in its Operation Manual, Roll Mill RSB 851 (4135), SB 851 (4131), pg. 27, Item 4.4.2.8 and pg. 28, FIG. 5, the installation of cleaning lips (P2) on the rolls of a 3 over 3 rolling mill. The cleaning lip is made by combining a carrying means and a lip. The cleaning lip is disposed at such an angle to the roll, that the wiping edge of the lip runs parallel to the longitudinal axis of the roll. Further, the cleaning lip under bending stress assumes a curved position on the roll. Upon the rotation of the roll, the cleaning lip removes the accumulating impurities from the outer surface of the roll and aids in cleanliness of operation.

As the said operational manual illustrates, the impurities fall away from the cleaning lip and are picked up by a pneumatically operating suction system of the rolling mill for disposal.

Illustration 5 in the manual shows that the lip has a relatively extended length which calls for a contact position at the roll dependent upon the direction of rotation. Upon a reverse of rotation for a short interval, (which an operator does to correct wrapping on the roll) the approach position of the wiping edge of the cleaning lip changes itself in such a way that upon the subsequent return to forward rotational motion by the roll, the wiping edge of the cleaning lip does not resume its previous approach position. In such a case, the function of the cleaning lip is substantially limited. The approach position of the wiping edge must then be additionally monitored and corrected.

When in operation, the cleaning lip is exposed to powerful mechanical and thermal demands. A mechanical stress arises from heavy contamination of the roll or from wrapping formation. The friction between the lip and the outer surface of the roll leads to high thermal conditions. This leads to the situation, that in a very short period, the wiping edge of the lip no longer forms a constant, uniform, contact line on the outer surface of the roll. Evidence exists that the wiping edge corrugates or wears away and no longer lies on the outer roll surface with the entire edge. Then a varied rate of heat expansion exists between the carrier means and the lip.

Under these circumstances, the function of the cleaning and contamination removal of the surface of the roll deteriorates. This requires a replacement of the cleaning lip. At present, the durability of the cleaning lip is relatively short.

In the state of the technology, there have been further attempts to improve the cleaning lip. CH 681 459 A5 exhibits the purpose of assuring a good exchangeability of the rubber element (corresponds to the lip) and to increase the wiping effect. From the standpoint of the technical construction, the said rubber element is expensive.

DE 34 22 139 presents the purpose of creating a wiper (i.e. cleaning lip) which functions reliably and the manufacture of which is economical. In this case, simultaneously, the disadvantages arising from a stiffening of the wiping lip are to be avoided. The stiffening is achieved principally through a structural arm of the holding bar. By this means, the flexibility of the lip is limited, which is not desirable where wrapping is the problem. A corrugated structural member on the back side of the lip requires an increased cost of manufacture. Since the longitudinal grooves and ribs (corrugated structural member) run to the wiping edge, one must consider increased local abrasion in the area of the grooves at the border of the wiping edge. As FIG. 1 of DE 34 22 139 C2 shows, the wiping edge of the cleaning lip therein is disposed at a small gap from the cylinder. The cleaning action is thereby limited disadvantageously where wrapping is concerned. The DE 34 22 139 C2 claims a weakening of the wiping lip in both the longitudinal and cross direction. In spite of the costly form of the wiping lip, it amounts to a corrugation of the wiping edge.

EP 45 725 shows a lip with a stiffening (ribs) on the free end of the lip. The expectation is that a longer durability will be achieved in this manner. On the grounds of the relatively great stiffness or rigidity, there still arises the increased danger of fissure formation at the lip, which does not lead to any increase in durability.

OBJECTS AND SUMMARY OF THE INVENTION

Thus, a purpose of the invention is to increase the durability of a cleaning lip for a rotating roll in a rolling mill processing textile fiber material and at the same time to improve the impurity removal of the cleaning lip on the roll. Additional objects and advantages of the invention will be set forth in part in the following description, or may be obvious from the description, or may be learned through practice of the invention.

The purposes will be achieved, in that on the lip, in proximity to the carrying means, a groove is made which runs parallel to the wiping edge of the lip. By means of this groove, the cross section of the lip is weakened at a specified place and the course of a bending line in the material of the lip is accentuated at this location. It is thereby achieved, that, extending from the groove, defined bending lines extend in the interior of the material to the wiping edge, which represents a defined, that is, repeatable bending line. Thus, it has been assured, that along the length of the groove, on the wiping line, a nearly constant bending tension exists in differential-like small increments. Furthermore, the bending stiffness as the carrier means is approached is reduced.

With a vertical disposition of the side edges of the lip (relative to the wiping edge), an abrupt break in the materials of the lip occurs. In order to equalize the side edges disposed at right angles (relative to the wiping edge) to small bending stress at that location, a greater bending stress is permitted. This is achieved, since, in one embodiment, the groove is not run to the side edges. This inhibits fissure formation in the area of the side edges.

In another embodiment, a groove is caused to be on the lip in proximity to the carrying means, which groove runs parallel to the wiping edge of the lip over the entire length of the lip and wherein each side edge meets the wiping edge at an obtuse angle.

The cleaning lip in accord with the invention brings forth the advantage, that along with a substantially greater durability, a continuous contact line of its wiping edge on the outer surface of the roll is assured.

The solution in accord with the invention also enables the lips to be shaped shorter (shorter on side edges), and consequently less length of lip is realized. The space between the wiping edge of the lip and the bordering edge of the carrying means is thus made substantially less. This reduces the amount of material used in the making of the lip.

In turn, the dirt chamber underneath a rolling mill can be made smaller, that is, a shortened arrangement on the framing of the rolling mill is made possible, or more free room for the lower rolling mill vacuum system is made possible, if the cleaning lip has a smaller length. This acts also advantageously in regard to the air piping for the pneumatic vacuum system.

Upon the reduction of lip distance from carrier to wiping edge, independence from the direction of rotation of the roll is also attained. If a brief reverse rotation of the roll leads to a reverse swing of the lip from its normal approach position, then a self move of the lip back to original position upon subsequent forward rotation of the roll is assured.

In injection molding, die casting procedure, the lip can be integrally affixed to the carrying means. Advantageously, no further recesses in material are necessary on the carrying means. The carrying means itself can be made of plastic. In this way, a difference in thermal expansion between the carrying means and the lip is avoided.

The ends of the carrying means are so shaped that, essentially, they must be inserted into a securing device. The carrying means, in a middle portion where the lip is affixed, can be linearly extended and bent in at both ends (see sections 100 in FIG. 2). The holder thereof is advantageously a guide groove on the bearing structure of the roll. The guide groove already available on the bearing forms a base on which the carrying means of the cleaning lip can be set up and affixed, so that no additional adjustment of the cleaning lip is necessary. At least the bent end part of the carrying means corresponds in its material thickness to the width of the guide groove in the securement means. The carrying means can be materially reinforced in its middle section in relation to the two end zones of said carrying means. This allows, that the carrying means can only be installed in a specified position in its holder, i.e., the groove on the lip is to be oppositely situated to the rolling mill.

In a further embodiment of the invention, it is provided, that within the material of the lip, between the groove and the wiping edge, a reinforcing bar is to be enclosed. The encapsulation of said bar is done by injection molding techniques. Preferably, the rod will be of metal. By doing this, an improvement in the stiffness is obtained.

In yet another embodiment, the depth of the groove is less than, or equal to, half of the thickness of the material of the lip.

Embodiment examples in accord with the invention are presented in drawings, and are described in more detail in the following.

BRIEF DESCRIPTION OF THE DRAWINGS

FIG. 2 is a front view of a cleaning lip with groove,

FIG. 3 is a side view of a cleaning lip with groove,

FIG. 3*a* is a side view of a cleaning lip with groove and encapsulated bar.

DETAILED DESCRIPTION OF THE PREFERRED EMBODIMENTS

Figure 1:
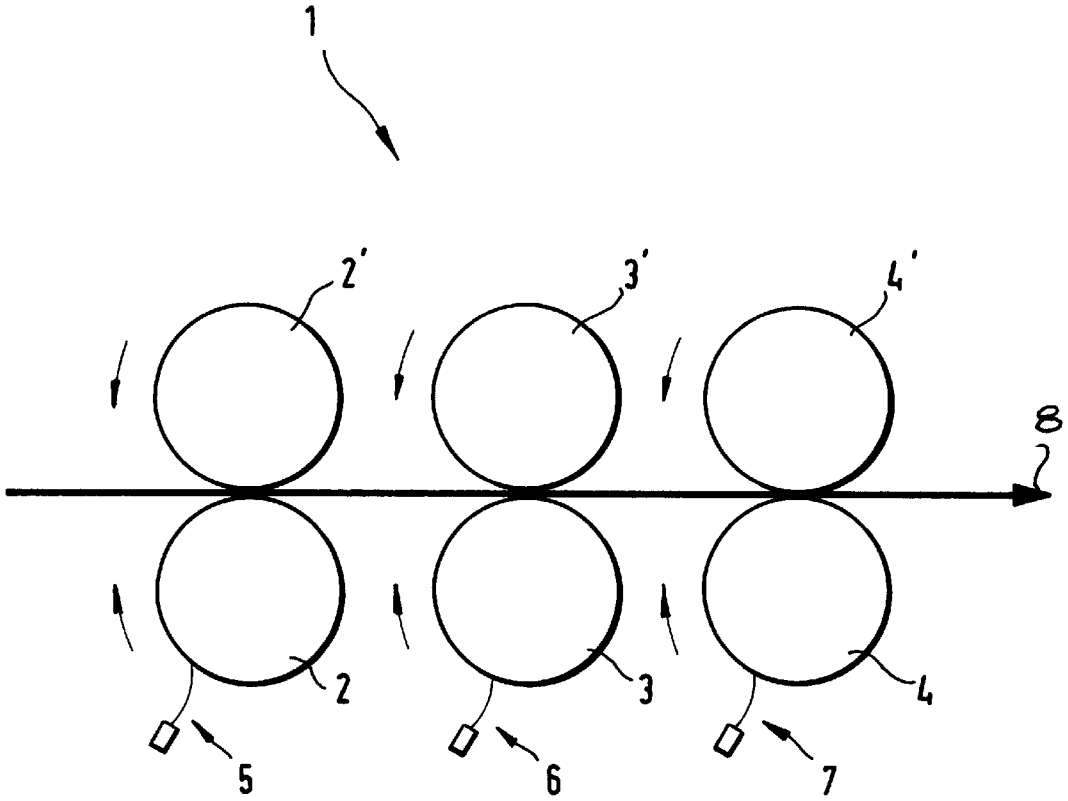
FIG. 1 shows rolls of a rolling mill with cleaning lips.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. Such modifications and variations are within the scope and spirit of the invention.

FIG. 1 shows, schematically, three stands of rolls, pair 2, 2', pair 3, 3' and pair 4, 4' of a rolling mill 1. Fiber material is conveyed in accord with the direction of travel 8 through said rolling mill 1. The direction of rotation of the rolls is indicated by arrows. Installed on each of the lives rolls of the roll pairs is a cleaning lip denoted respectively by 5, 6, 7. The cleaning lips 5, 6, 7 touch the outside surfaces of the lower rolls with their respective wiping edges.

Because of the design of the rolling mill, and therewith the position of lower rolls in relation to the rolling mills basic structure, often the lengths of the individual cleaning lips for the rolls of a rolling mill are different. This is not sensible. If, however, one goes to a uniform length of the cleaning lips, then on the rolling mill, adjustable retaining means must be at hand, in order to position the lips in their proper places.

Figure 5:
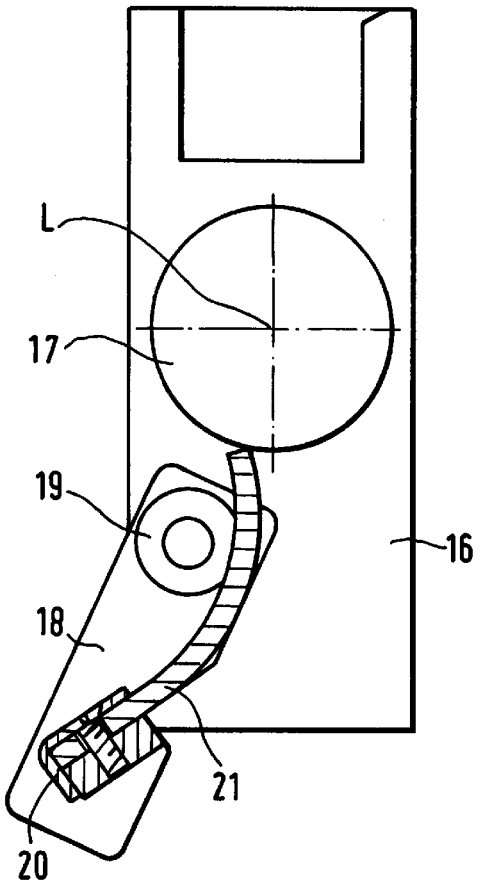
FIG. 5 is a schematic view of the securement of a cleaning lip in accord with the state of the technology.

FIG. 5 depicts such a retaining means in the state of the technology of a known retaining means 18. The retaining means 18 accepts the cleaning lip 21 in a guide groove 20. The retaining means 18 is fastened by a releasable securement 19 on bearing 16 for lower roll 17.

The longitudinal axis L of the roll 17 is at right angles to the plane of the drawing.

The approach angle for the cleaning lip 21 on the roll 17 is achieved by turning and affixing the holder 18 about the securement means 19 which serves as the turning axis.

This is expensive, but otherwise the possibility exists of making incorrectly the installation for the approach angle of the cleaning lip, since, especially in the case of the lower rolls, visual inspection is difficult.

FIGS. 2 and 3, show a cleaning lip 9, which essentially is comprised of a carrier means 10 and a lip 11. The carrier means 10 can be a rod, a tube, or a flat strip. The cleaning lip 11 is integrally united with the carrier means 10 by injection molding. The lip 11 is generally rectangular in outline whereby the lip is limited in its length by the side faces $S_1$, $S_2$. The length of the lip 11 essentially corresponds to the length of the outer surface of the roll 17. The length of the lip 11 terminates at the wiping edge AK. The wiping edge AK of the lip runs parallel to the longitudinal axis of the roll 17 and lies upon the outer surface of said roll under bending stress. The lip is composed of an elastic plastic. The elastic plastic has a Shore A-hardness of less than or equal to 90. On the lip 11 in proximity to the carrier 10, a groove 12 is placed, which groove runs parallel to the longitudinal axis of the roll over a section of said lip 11 which ends at the distance A from each of the two side faces $S_1$, $S_2$. The groove can be placed either on the concave or the convex side of the lip. (see operational placement of the lip, FIG. 6). The depth of the groove is equal to, or less than one half of the thickness of the lip. This groove will improve the flexure stress of the lip as it lies against the outer surface of the roll, so that an unbroken wiping line of the edge is formed on said outer surface. As shown in an embodiment of the invention, (FIG. 3*a*), a bar (ST) is embedded in the elastic plastic between the groove 12 and the wiping edge AK. The stiffness of the lip is improved by this means. This bar is advantageously a metal bar.

Figure 4:
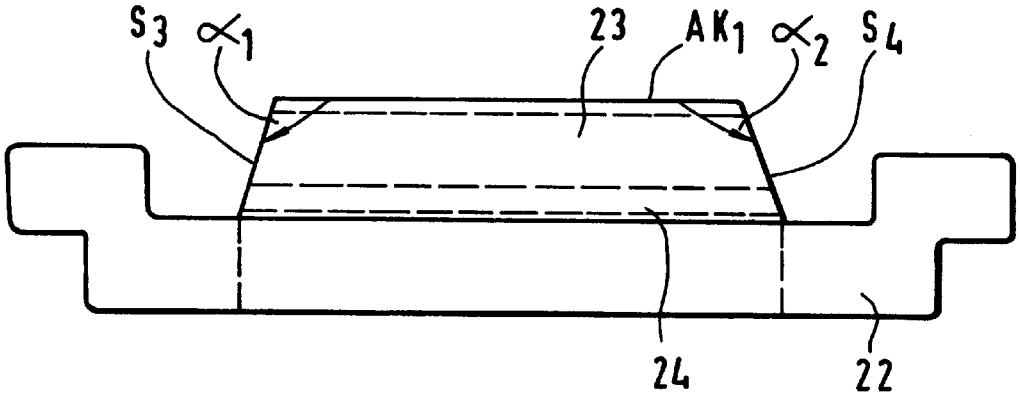
FIG. 4 is a cleaning lip with groove and inclined side edges on lip.

FIG. 4 presents another embodiment. In this case, a lip 23 is integrally molded to a carrier means 22. The said lip 23 possesses a groove 24 in proximity to the carrier means, which groove runs parallel to the longitudinal axis of the roll and over the entire width of the lip, and wherein the side edges $S_3$, $S_4$ meet the wiping edge $AK_1$ at obtuse angles $\alpha_1$, $\alpha_2$.

Figure 6:
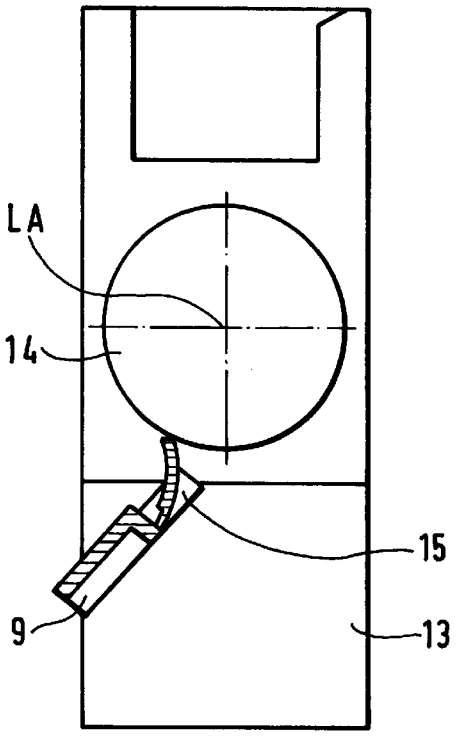
FIG. 6 is a schematic view of a securement means for the cleaning lip

FIG. 6 shows an improved holding means for the cleaning lip 9. A roll 14, the longitudinal axis LA of which is perpendicular to the plane of the drawing is installed in a bearing 13 (corresponding to a holding means). The bearing 13 has a guide groove 15, into which a cleaning lip 9 is inserted as far as a detent and may be fixed in that position. So that the cleaning lip consistently assumes a desired installation position with the groove on the side of the lip (whether or not said lip is convex or concave in its approach curve to the surface of the roll), the carrier means can be materially reinforced in its middle zone, opposite to the two end portions of the carrier means, so that a one-way-only insertion position into the installation position can be made.

The detent of the groove 15 is so shaped, that upon the use of lips of uniform length, their wiping edges lie on the outer surface of the roll with a slight bending (see FIG. 6). This corresponds to the operational positioning of the lip on the roll during forward rotation. There is a reverse positioning of the lip, which it automatically assumes upon the corresponding reversal of the roll 14, and then, when the roll returns to its forward rotation, the lip itself reassumes its original position. It has been found that the tangential force component of the cleaning lip on the contacting position on the cylinder in accord with the invention, is greater than that of the conventional state of the technology (FIG. 5).

Further, it has become evident, that the cleaning lip, in accord with the invention, can be used to avoid wrapping. In this case, the carrying means of the cleaning lip is releasably affixed parallel to the roll at an intervening distance. The wiping edge of the lip runs parallel to the longitudinal axis of the roll and thus takes a position on the roll surface under flexural stress. The roll can be driven forwards or backwards.

Under these conditions, wrapping can be avoided, in that upon reversed rotation of the roll from its original direction, the wiping edge of the lip bends itself from its original position into a corresponding reverse position relative to the roll. When the roll resumes its original direction of rotation, the wiping edge of the lip also reverses itself back to its original posture against the surface of the roll. Through this self induced back and forth swinging of the lip, the wrapping is cleared by the scraping of the said wiping edge on the outer surface of the roll.

FIG. 6 also makes clear, that the cleaning lip with its abbreviated length (at least 10 mm to, at the most, 15 mm) demands less room in the lower space of the rolling mill. Thus, better conditions for the vacuum removal as well as the designed formulation or use of the said lower space have been thereby created.

It should be appreciated by those skilled in the art that various modifications and variations can be made in the present invention without departing from the scope and spirit of the invention. It is intended that the present invention include such modifications and variations as come within the scope of the appended claims and their equivalents.

We claim:

1. A cleaning lip apparatus for cleaning rotating rolls of a textile machine, said apparatus comprising a carrying device and an elastic lip integrated with said carrying device, said lip having a length delimited by a wiping edge, said wiping edge running parallel to said rotating rolls, said lip further comprising a groove defined therein running essentially parallel to said wiping edge, said groove defining a bending line for said lip, said lip extending generally unrestrained over a length thereof from said carrying device to said wiping edge so that said lip can swing from a normal approach position relative to the rotating roll to a reverse position upon a reversal of the rotating roll, and back again to said normal approach position upon a subsequent return of the rotating roll to its normal operational rotational direction.

2. The apparatus as in claim 1, wherein said lip is defined between opposite side edges, said groove set off a distance from each of said side edges.

3. The apparatus as in claim 1, wherein said groove extends along an entire width of said lip.

4. The apparatus as in claim 1, wherein said lip is defined between opposite side edges thereof disposed at essentially right angles to said wiping edge, said groove set off a distance from each of said side edges.

5. The apparatus as in claim 1, wherein said lip is defined between opposite side edges thereof disposed at essentially obtuse angles with said wiping edge, said groove extending along an entire width of said lip.

6. The apparatus as in claim 1, further comprising an essentially rigid member embedded in said lip along said width thereof between said groove and said wiping edge.

7. The apparatus as in claim 1, wherein said rigid member is formed of a metal.

8. The apparatus as in claim 1, wherein said groove has a depth in said lip less than or equal to half of a thickness of said lip.

9. The apparatus as in claim 1, wherein said lip is formed of an elastic plastic material having a Shore A-hardness of less than or equal to 90.

10. The apparatus as in claim 1, wherein said carrying device is materially reinforced in said linearly extending portion as compared to said bent portions.

11. The apparatus as in claim 1, wherein said carrying device is formed of a plastic material.

12. A cleaning lip apparatus for cleaning rotating rolls of a textile machine, said apparatus comprising a carrying device and an elastic lip integrated with said carrying device, said lip having a length delimited by a wiping edge, said wiping edge running parallel to said rotating rolls, said lip further comprising a groove defined therein running essentially parallel to said wiping edge, said groove defining a bending line for said lip, and wherein said carrying device comprises a linearly extending portion in a middle area thereof and bent portions at end areas thereof on either side of said linearly extending portion.

* * * * *